US006818253B2

(12) United States Patent
Kimbrell

(10) Patent No.: US 6,818,253 B2
(45) Date of Patent: Nov. 16, 2004

(54) METHOD OF PRODUCING TEXTILE SUBSTRATES HAVING IMPROVED DURABLE WATER REPELLENCY AND SOIL RELEASE

(75) Inventor: William C. Kimbrell, Spartanburg, SC (US)

(73) Assignee: Milliken & Company, Spartanburg, SC (US)

( * ) Notice: Subject to any disclaimer, the term of this patent is extended or adjusted under 35 U.S.C. 154(b) by 87 days.

(21) Appl. No.: 10/272,049

(22) Filed: Oct. 16, 2002

(65) Prior Publication Data

US 2003/0116744 A1 Jun. 26, 2003

Related U.S. Application Data

(63) Continuation of application No. 09/611,550, filed on Jul. 7, 2000, now abandoned.

(51) Int. Cl.[7] ..... D06M 15/256; D06M 15/285

(52) U.S. Cl. ..... 427/393.4; 442/82; 442/88; 442/94; 252/8.62; 525/199; 525/200; 524/520

(58) Field of Search ..... 427/393.4; 442/82, 442/88, 94; 252/8.62; 525/199, 200; 524/520

(56) References Cited

U.S. PATENT DOCUMENTS

| | | | | | |
|---|---|---|---|---|---|
| 3,503,915 | A | * | 3/1970 | Peterson | 524/507 |
| 3,597,145 | A | * | 8/1971 | Marco | 8/115.6 |
| 3,598,514 | A | | 8/1971 | Sello et al. | |
| 3,645,990 | A | | 2/1972 | Raynolds et al. | |
| 3,896,088 | A | | 7/1975 | Raynolds | |
| 4,421,796 | A | | 12/1983 | Burril et al. | |
| 4,624,676 | A | | 11/1986 | White et al. | |
| 4,624,889 | A | | 11/1986 | Bries | |
| 4,668,726 | A | | 5/1987 | Howells | |
| 4,695,488 | A | | 9/1987 | Hisamoto et al. | |
| 4,748,267 | A | | 5/1988 | Chang | |
| 5,009,667 | A | * | 4/1991 | Beck et al. | 8/115.56 |
| 5,073,442 | A | * | 12/1991 | Knowlton et al. | 442/94 |
| 5,258,458 | A | | 11/1993 | Allewaert et al. | |
| 5,395,868 | A | * | 3/1995 | Sanduja et al. | 524/104 |
| 5,654,068 | A | * | 8/1997 | Pechhold | 252/8.62 |
| 5,672,651 | A | | 9/1997 | Smith | |
| 5,714,082 | A | | 2/1998 | Boardman et al. | |
| 5,744,201 | A | * | 4/1998 | Chang et al. | 427/393.4 |
| 5,750,445 | A | * | 5/1998 | Pechhold et al. | 442/168 |
| 5,888,290 | A | | 3/1999 | Engle et al. | |
| 5,899,783 | A | | 5/1999 | Kimbrell, Jr. et al. | |
| 6,043,209 | A | * | 3/2000 | Micciche et al. | 510/280 |
| 6,136,730 | A | | 10/2000 | Kimbrell, Jr. et al. | |
| 6,162,369 | A | | 12/2000 | Allewaert et al. | |
| 6,197,378 | B1 | | 3/2001 | Clark et al. | |
| 6,224,782 | B1 | | 5/2001 | Allewaert et al. | |
| 6,239,247 | B1 | | 5/2001 | Allewaert et al. | |
| 6,309,752 | B1 | | 10/2001 | Dams et al. | |
| 6,379,753 | B1 | | 4/2002 | Soane et al. | |
| 6,383,633 | B1 | | 5/2002 | Allewaert et al. | |
| 6,416,613 | B1 | | 7/2002 | Patrick et al. | |
| 2003/0001130 | A1 | | 1/2003 | Qui | |

* cited by examiner

*Primary Examiner*—David J. Buttner
(74) *Attorney, Agent, or Firm*—Terry T. Moyer; John E. Vick, Jr.

(57) ABSTRACT

A process for imparting durable water and oil repellency and durable soil release characteristics comprises the application of an aqueous mixture having a water repellent component such as a fluorocarbon polymer and a separate hydrophilic soil release polymer to a textile substrate, followed by a drying step. Optionally, a curing or thermosetting step may also be employed, if desired. This process is carried out in a preferred embodiment in a generally mild pH, which allows the process to be performed on a wide variety of textile substrates that may not be capable of withstanding more extreme pH values. Polyamides, aramids, polyesters, and poly/cotton substrates, when treated according to the present process, have all yielded improved performance with respect to durable water and oil repellency and durable soil release characteristics. A novel mixture or bath and novel treated substrates are also disclosed.

3 Claims, 8 Drawing Sheets

*Figure 1: NYLON DWR/SR Soil Release Ratings*
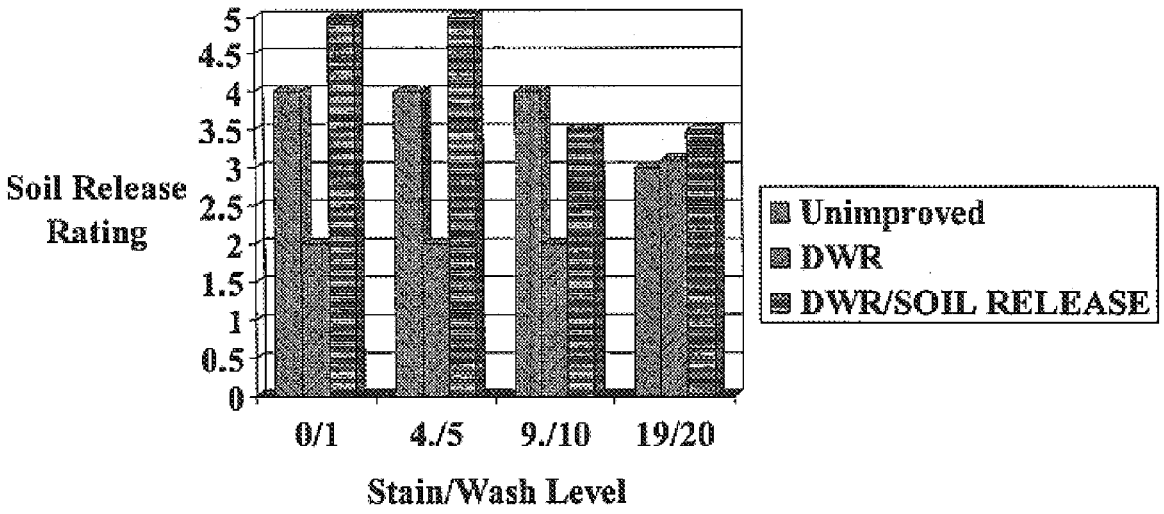

Figure 2: NYLON DWR/SR Soil Release
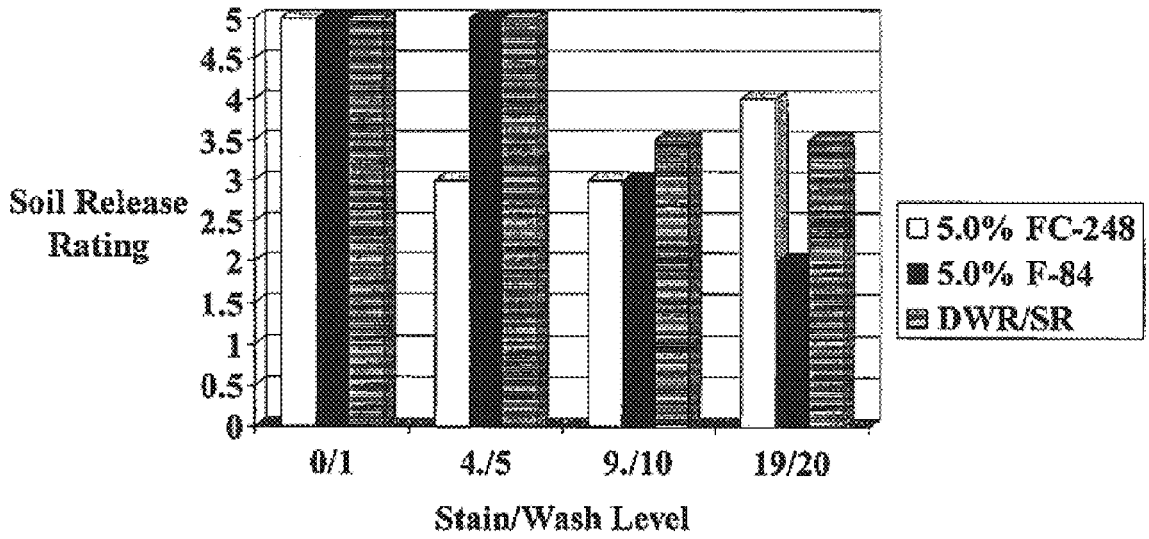

*Figure 3: NYLON DWR/SR Spray Ratings*
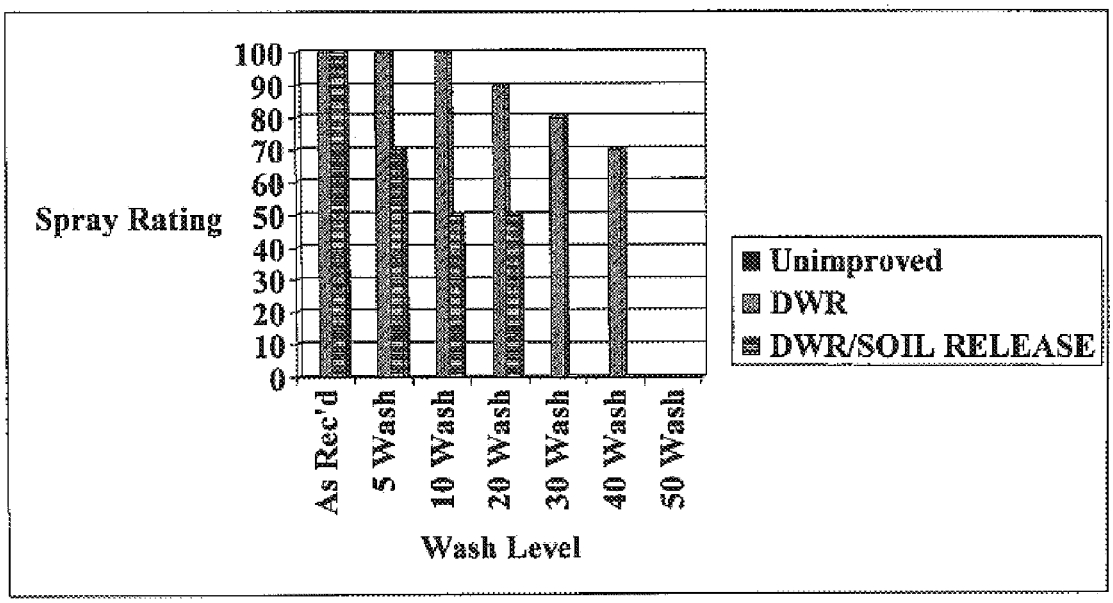

Figure 4:NYLON DWR/SR Spray Ratings
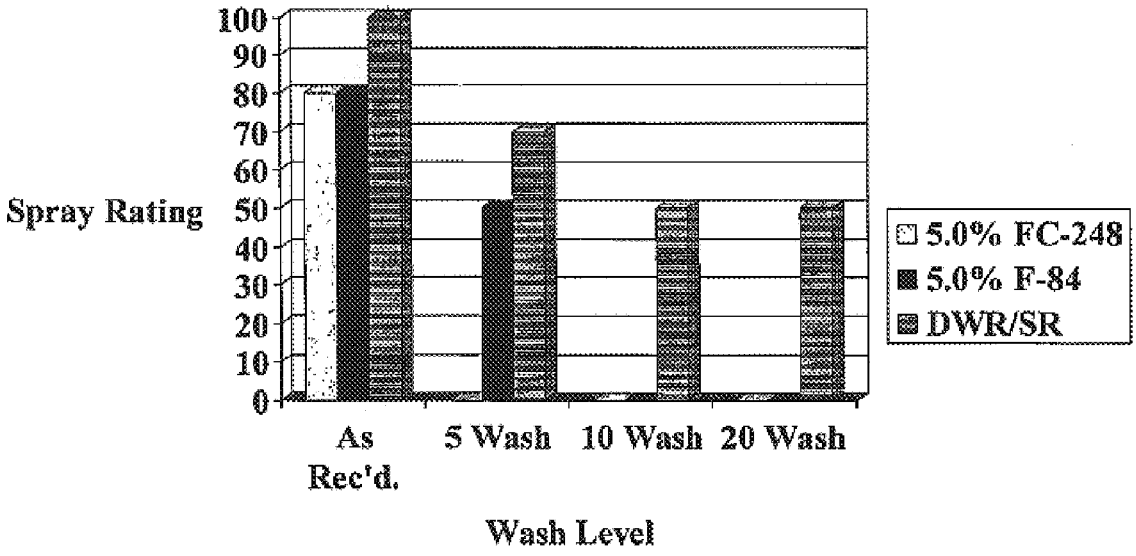

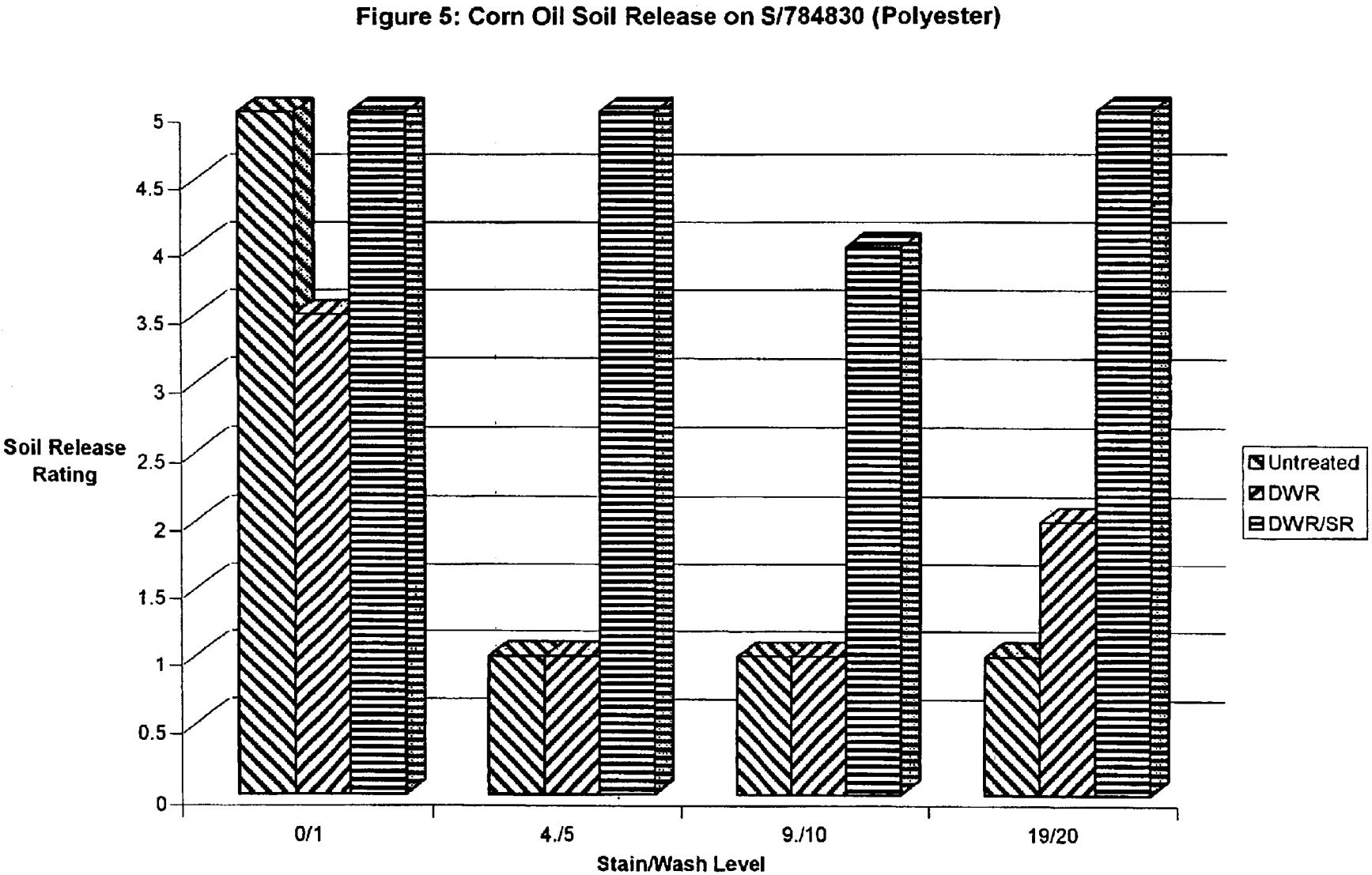
Figure 5: Corn Oil Soil Release on S/784830 (Polyester)

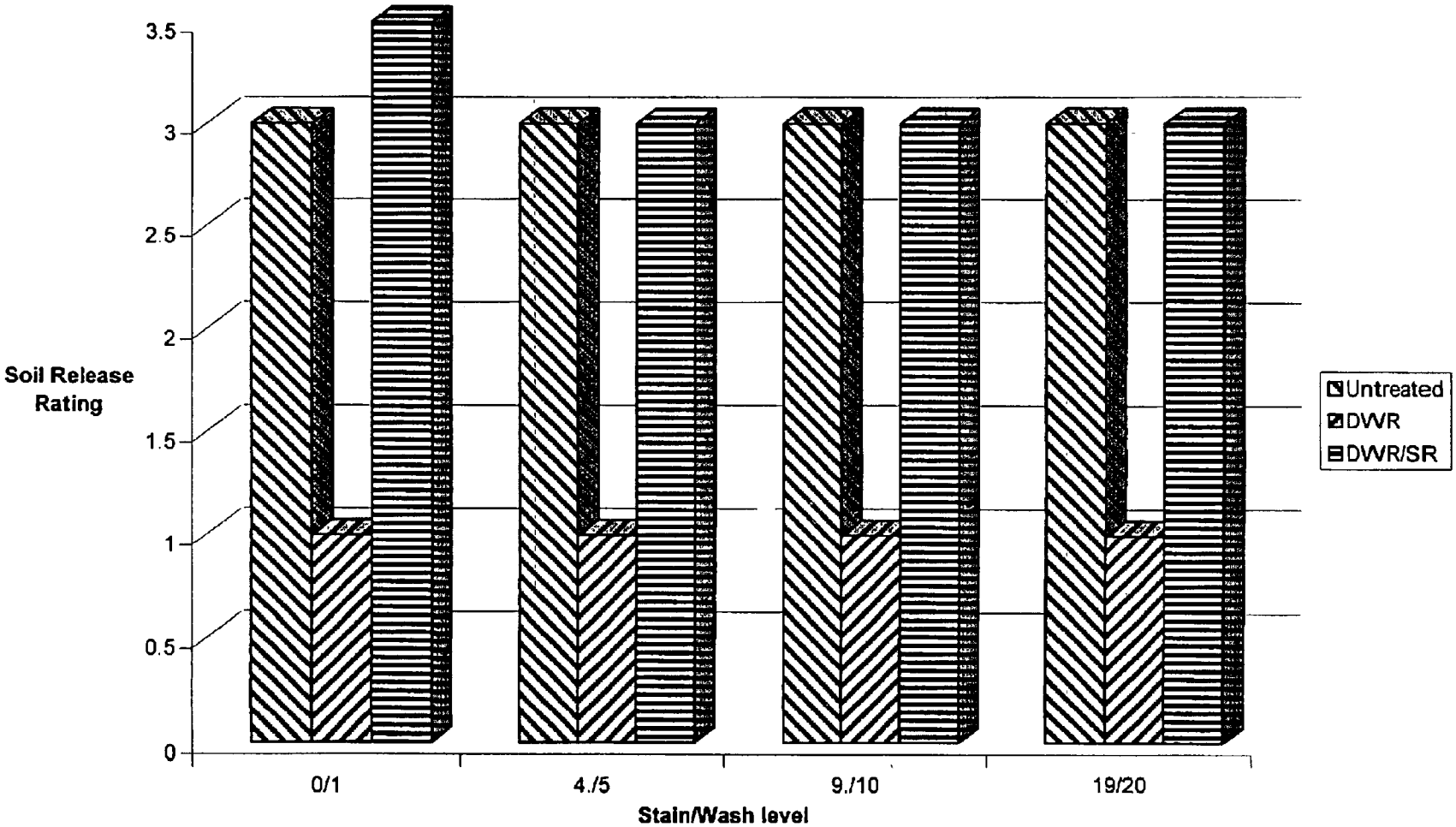
Figure 6: Corn Oil Soil Release on Cotton

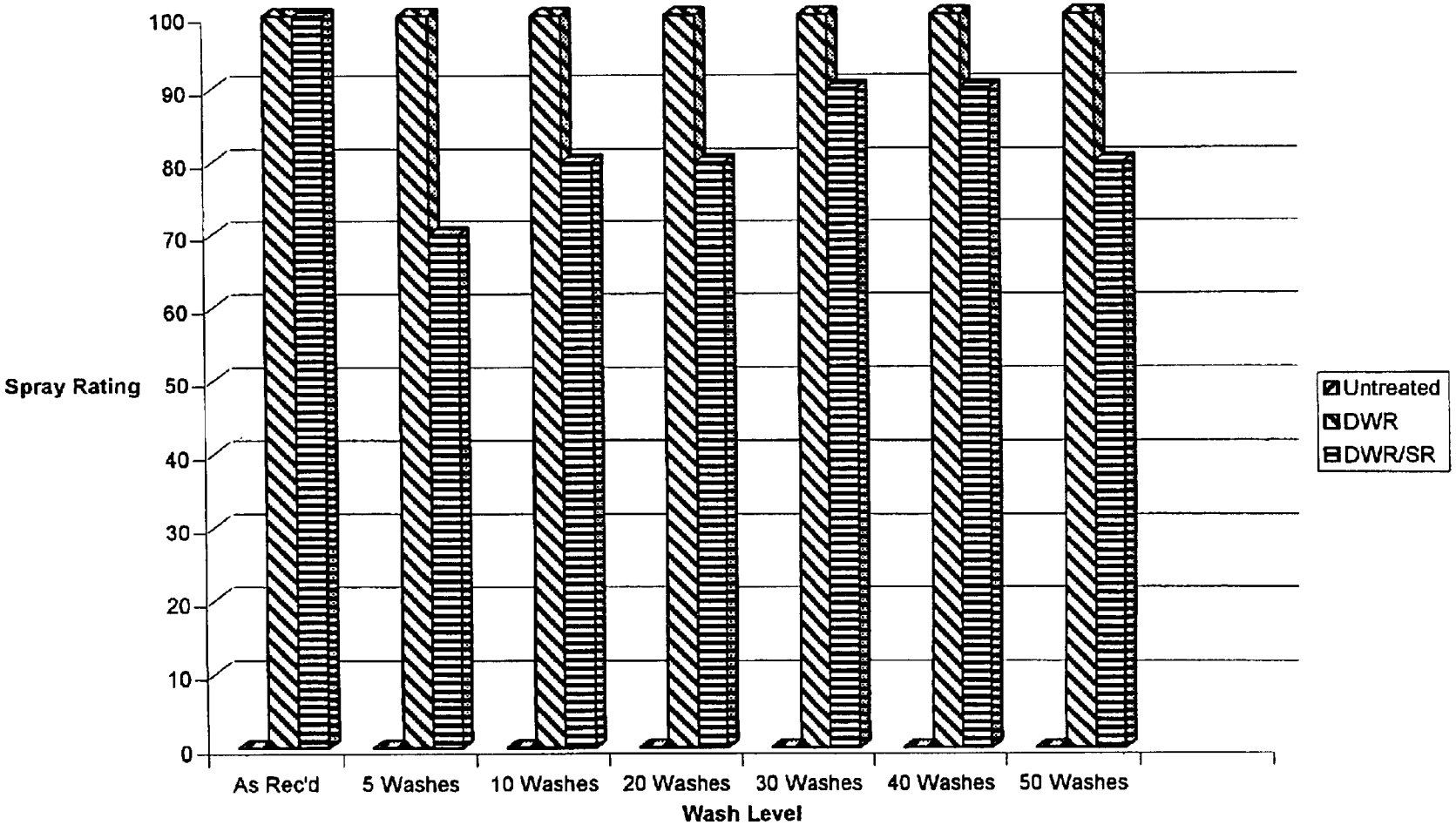
Figure 7: Polyester Water Repellency

Figure 8: Cotton Water Repellency
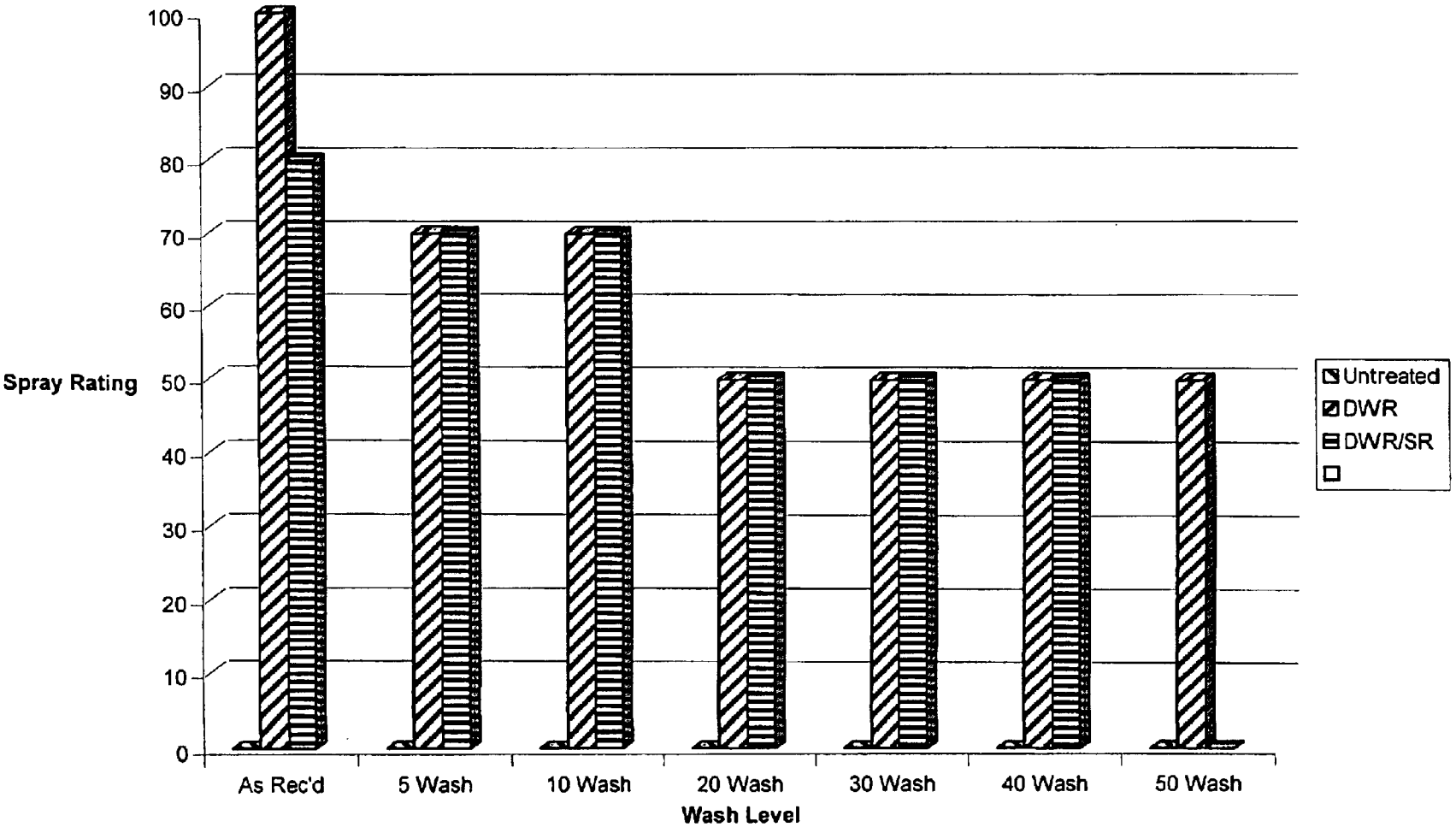

METHOD OF PRODUCING TEXTILE SUBSTRATES HAVING IMPROVED DURABLE WATER REPELLENCY AND SOIL RELEASE

This application is a continuation of prior application Ser. No. 09/611,550 filed on Jul. 7, 2000 now abandoned.

BACKGROUND OF THE INVENTION

1. Field of the Invention

The present invention relates to a treatment for imparting durable water repellency and soil release properties to textile substrates, as well as the products produced by the treatment process.

Substrates that possess water and oil repellency are desirable in many textile applications, and have been manufactured for some time. Water and oil repellency generally means the ability of the textile to block water and oil from penetrating into the fibers of the textile. Examples include rainwear, upholstery applications, carpet and the like. These articles are generally manufactured by applying suitable fluorocarbon polymers to the surface of the textile, followed by drying and curing the substrate to properly align the fluorochemical segments of the polymers. Suitable polymers are available from 3M, DuPont and various other manufacturers. Fluorochemicals also help to reduce the tendency of soil, oil, and water to adhere to the fibers of the substrate. These fluorochemicals typically include a fluorinated component and a nonfluorinated polymeric backbone. The important feature of the polymeric backbone is that it is capable of forming a durable film on the surface of the fiber.

Similarly, substrates possessing acceptable soil release characteristics are known. As used herein, soil releasability is defined as the degree to which a soiled substrate approaches its original, unsoiled appearance as a result of a care procedure. Examples include natural fibers such as cotton, hydrophilic synthetic fibers such as nylon and acrylic, and synthetic polymers that have been modified to improve soil releasability by the application of hydrophilic soil release polymers. Suitable soil release polymers include carboxylic acid containing copolymers, sulfonic acid containing copolymers, ethoxylated polyesters, certain polyacrylamide polymers and certain cellulose derivatives.

Extensive efforts have been made to produce a textile substrate having the properties of durable water and oil repellency, as well as improved durable soil release characteristics. Generally, treatments are available to impart either one of these properties to a textile, but it has proven difficult to provide both properties to a single substrate for any appreciable length of time. One method for treating substrates to simultaneously impart both of these characteristics has been to use copolymers containing fluorocarbon oil/water repellent segments and hydrophilic soil release segments. Examples of such copolymers include Scotchguard FC-248 from 3M, and Repearl F-84, marketed by Mitsubishi Chemical. These products provide a degree of water/oil repellency and adequate soil release to many substrates, but the oil/water repellency is lower than that obtained with traditional fluorochemical polymer treatments. Further, the copolymers tend to lack durability for many applications. Durability is defined herein as retaining an acceptable level of the desired function through a reasonable number of care cycles. Specifically, for purposes of the present application, durability is defined as having a spray rating of at least 50 after 10 wash cycles, and soil release ratings of at least 3.0 through 10 washings, under the AATCC tests outlined and referenced below.

Natural fibers such as cotton and wool exhibit little water/oil repellency, but when they do become soiled, they are readily cleaned, thus exhibiting a high level of soil releasability. Many synthetics, notably polyester, exhibit a low level of soil releasability. Thus, the trend of producing textiles having a natural/synthetic blend of fibers tends to aggravate the situation because such blends are easily soiled and the absorbed soil is difficult to wash out. As mentioned above, fluorocarbons have been applied to textiles in attempts to solve this problem by providing limited protection against oily stains due to the oleophobic properties of most fluorocarbons. However, they tend to make the soil release properties worse because the aqueous washing medium cannot properly wet the substrate, and hence cannot remove the stains. Conversely, the addition of hydrophilic soil release polymers tends to enhance the soil release characteristics, but limits the ability of the textile to resist and repel water and oil based liquids.

2. Description of the Prior Art

All patents mentioned are incorporated herein by reference. Many attempts have been made to solve the above problems. U.S. Pat. No. 3,706,594, issued to Wasley, et al., is directed to a copolymer including fluoroalkyl allyl (or methallyl) ethers copolymerized with maleic anhydride. These copolymers are applied to fibrous materials to provide both soil repellency and soil releasability. One problem with using a single copolymer having both hydrophobic and hydrophilic properties is that it has proven difficult to obtain the necessary balance between the two properties. Commercial copolymers tend to exhibit acceptable soil release performance, but lower initial repellency and a lack of durable repellency. Without wishing to be bound by this theory, it is believed that incorporation of sufficient hydrophilic segments to provide acceptable soil release tends to adversely affect the solubility of the copolymer and/or the adhesive forces between the copolymer and the fiber, resulting in a negative effect on durability.

U.S. Pat. No. RE028,914, issued to Marco, describes a process to impart water repellency, soil release and durable press properties to a cellulose containing substrate. The cellulose containing textile is treated with a fluorocarbon polymer, a synthetic acid soil release copolymer, an aminoplast resin and a resin catalyst. The fluorocarbon polymer and soil release polymer are crosslinked to the cellulose to yield durability of the properties obtained. This treatment only works with textile fibers that contain cellulose, which excludes most synthetic fibers.

U.S. Pat. No. 4,007,305, issued to Kakar, et al., teaches a substrate treatment process of applying a mixture of fluorocarbon polymers and carboxylic acid containing soil release copolymers to textiles to yield non-durable water, oil and soil repellency and non-durable soil release properties.

U.S. Pat. No. 5,520,962, issued to Jones, Jr., discloses a method and composition for treating carpet yarn and carpet to enhance the repellency and stain resistance. An anionic or nonionic fluorochemical compound and an anionic binding compound (preferably a polymethacrylic acid polymer) are provided in an aqueous medium, which has a pH below about 3.5. The carpet yarn is immersed in the aqueous medium, which is then heated. Subsequently, the excess water is removed from the carpet yarn. Stain resistance is achieved by utilizing an agent to block dye sites on the nylon fiber. For instance, amine groups of the fiber may complex with acid groups in the stain resist polymer, thereby blocking these sites to staining by acid dyes, such as those found in Kool-Aid, etc. Thus, stain resist agents may be distinguished from soil release agents, as they perform different functions in different manners.

U.S. Pat. No. 5,948,480, issued to Murphy, is directed to a process wherein a first bath including a stain resist agent is applied to a carpet, and then a second bath containing a fluorochemical soil resist agent is applied to the carpet.

However, none of the above-mentioned prior art discloses a single bath treatment for a wide variety of textile fibers that provides durable water and oil repellency and durable soil release characteristics. Moreover, none of the prior art discloses a composition that may be used in a single textile treatment for imparting those characteristics. Further, none of the prior art discloses a textile substrate product that has obtained these characteristics through a single bath treatment. Thus, in spite of a longstanding need and consumer demand for textile substrates having durable water and oil repellent attributes as well as durable soil release characteristics, other attempts have fallen short.

OBJECTS OF THE INVENTION

Accordingly, an important object of one aspect of the present invention is to provide a process for treating a wide variety of textile substrates in order to impart improved durable water and oil repellency, as well as improved durable soil release characteristics.

Another important object of one aspect of the present invention is to provide a single bath composition that may be applied to a textile substrate to obtain durable water and oil repellency and durable soil release attributes.

Yet another important object of one aspect of the present invention is to provide a textile substrate that has improved durable water and oil repellency, as well as improved durable soil release characteristics.

Still another important object of one aspect of the present invention is to provide a method of treating textile substrates in a single bath that may be easily and inexpensively applied in a pre-existing wet-out box of a conventional tentering frame or operation, with no additional equipment requirements.

Although some objects of the present invention have been specified, these objectives should not be construed to limit the scope of the following claims in any way.

BRIEF DESCRIPTION OF THE DRAWINGS

These and other features, aspects, and advantages of the present invention will become better understood with regard to the following description, appended claims, and accompanying drawings where:

FIG. 1 is a graphical representation of a Soil Release Rating test of untreated nylon, nylon treated with a fluorocarbon polymer, and nylon treated with a combination between a fluorocarbon polymer and a soil release agent in accordance with the present invention;

FIG. 2 is a graphical representation of a Soil Release test for nylon treated by the FC-248, nylon treated by F-84, and a nylon treated with a combination between a fluorocarbon polymer and a soil release agent in accordance with the present invention. The FC-248 and F-84 compounds are both copolymers containing fluorocarbon oil/water repellent segments and hydrophilic soil release segments.

FIG. 3 is a graphical representation of a Spray Ratings test for water repellency of untreated nylon, a fluorocarbon treated nylon, and a nylon treated with a combination between a fluorocarbon polymer and a soil release agent in accordance with the present invention; and FIG. 4 is a graphical representation of a Spray Ratings test for nylon treated by FC-248, nylon treated by F-84, and a nylon treated with a combination between a fluorocarbon polymer and a soil release agent in accordance with the present invention;

FIG. 5 is a graphical representation of a Corn Oil Soil Release test for polyester (S/784830) including: untreated polyester, polyester treated with a durable water repellent, and polyester treated with a combination between a fluorocarbon polymer and a soil release agent in accordance with the present invention;

FIG. 6 is a graphical representation of a Corn Oil Soil Release test performed on cotton, including: untreated cotton, cotton treated with a durable water repellent, and cotton treated with a combination between a fluorocarbon polymer and a soil release agent in accordance with the present invention;

FIG. 7 is a graphical representation of a Spray Ratings test performed on polyester (S/784830) including: untreated polyester, polyester treated with a durable water repellent, and polyester treated with a combination between a fluorocarbon polymer and a soil release agent in accordance with the present invention;

FIG. 8 is a graphical representation of a Spray Ratings test performed on cotton including: untreated cotton, cotton treated with a durable water repellent, and cotton treated with a combination between a fluorocarbon polymer and a soil release agent in accordance with the present invention.

DESCRIPTION OF THE PREFERRED EMBODIMENT

The process of the present invention comprises coating a textile substrate with a mixture having a water repellent component, such as a fluorocarbon polymer, and a separate hydrophilic soil release polymer, followed by a drying step. Optionally, a curing or thermosetting step may also be employed, if desired. This process, when used on textile substrates, results in better and more durable water and oil repellency characteristics, as well as improved durable soil release attributes. The terms "fluorocarbons," "fluoropolymers," and "fluorochemicals" may be used interchangeably herein, and each represents a polymeric material containing at least one fluorinated segment.

The mixture used in the process, as stated above, preferably includes a fluorocarbon polymer and a hydrophilic soil release polymer. A variety of different fluorocarbon polymers may be employed in the mixture, including REPEARL F-8025, available from Mitsubishi Chemical, FC-251, sold by 3M, or Zonyl 8070, marketed by DuPont. In an alternate embodiment, the fluorocarbon component may be replaced with any of the following: a wax composition, a zirconium/wax complex, or a silicone polymer.

The hydrophilic soil release polymer may comprise any of the following: an acrylic soil release copolymer, Lubril QCX from Abco Industries, an ethoxylated polyester soil release polymer, FC-258, a sulfonated polyester soil release agent from 3M, or Milease HPA from Hodgson Process Chemicals, a sulfonated/ethoxylated soil release agent. Generally, acceptable soil release compositions may include copolymers of acrylic acid or methacrylic acid with ethylacrylate, or methylacrylate. The soil release agent may be anionic (such as a carboxylic acid containing polymer, or a sulfonic acid containing polymer), cationic (such as a polyacrylamide polymer), or nonionic (including the above ethoxylated polymers or certain cellulose derivatives). In choosing a soil release polymer for this mixture, it is advantageous to choose one that provides an acceptable degree of soil release attributes and does not adversely affect the fluorocarbon polymer function or durability.

The concentration range for the fluorocarbon polymer is between about 0.25% and 60% by weight of the mixture. The concentration range for the hydrophilic soil release polymer should be about 0.5% and 40% by weight of the mixture. In a preferred embodiment, the ratio of fluorocarbon polymer to the hydrophilic soil release polymer in the mixture should be between 1:1 and 5:1, and most preferably between about 3:1 and 3:2. In a most preferred embodiment, the mixture includes 3% by weight REPEARL F-8025, which is a Mitsubishi Chemical fluorocarbon polymer, 2% PD-75 (an acid containing acrylic copolymer from Milliken Chemical), and 95% water by weight. The PD-75 soil release agent is a carboxylated acrylic copolymer, which contains 70% methacrylic acid and 30% ethyl acrylate, and contains 16% solids.

Generally, the pH of the mixture should be at least 3, preferably above 4, and most preferably between 6 and 7. The pH should not rise above about 7 for this mixture. The range of the pH of the mixture should be determined by the pH tolerance of the textile substrate and the polymeric substances, as a mixture having an extremely acidic or basic pH may significantly weaken or destroy many textile substrates or the polymeric content of the mixture. The major component of the mixture by weight is preferably water, although any suitable solvent may be used. After the textile substrate has been coated and dried, in a preferred embodiment, the solid fluorocarbon component should comprise between about 0.05% and 10% on weight of the textile substrate, and the hydrophilic soil release agent should comprise between about 0.05% and 10% on weight of the substrate.

The following examples illustrate the process of applying the mixture to the textile substrates, and the effect of the process on the textile substrates:

EXAMPLE 1

A woven nylon substrate was scoured to remove any residual auxiliaries. This substrate was then padded with an aqueous solution of 3.00% REPEARL F-8025 and 2.00% PD-75 by weight. The term "padded" means a liquid coating was applied to textiles by passing the material through a bath and subsequently through squeeze rollers. The material was then squeezed to 100% wet pickup, dried and cured at 350 degrees F. This substrate exhibits improved water and oil repellency and good soil release performance through twenty home launderings. Table 1 shows the results of the Spray Rating (water and oil repellency) test, and Table 2 shows the results of the Soil Release Rating test.

EXAMPLE 2

A woven nylon substrate was scoured to remove any residual auxiliaries. This substrate was then padded with an aqueous solution of 3.00% REPEARL F-8025 by weight. After the padding step, the material was squeezed to 100% wet pickup, dried and cured at 350 degrees F. Without the addition of the soil release polymer, the oil and water repellency remained high, but the soil release performances were not acceptable, as shown in Table 2.

EXAMPLE 3

A woven nylon substrate was scoured to remove any residual auxiliaries. This substrate was then padded with a water solution. The material was then squeezed to 100% wet pickup, dried and cured at 350 degrees F. Without the addition of either the fluorochemical polymer or the soil release polymer, the substrate exhibits acceptable soil release properties, but no water or oil repellency.

EXAMPLE 4

A woven nylon substrate was scoured to remove any residual auxiliaries. This substrate was then padded with an aqueous solution of 5.00% FC-248 by weight. The material was then squeezed to 100% wet pickup, dried and cured at 350 degrees F. The material exhibits acceptable water and oil repellency characteristics immediately after treatment, but after 5 home launderings, the water repellency was rated at 0 under the Spray Ratings test.

In the above examples, the Spray Rating test was conducted in accordance with AATCC (American Association of Textile Chemists and Colorists) test method 22–1980, also shown in Table 1 below. These tests were run using varying concentrations of fluorocarbon polymers and hydrophilic soil release polymers, either alone or in combination, on a variety of different nylon substrates. The pH of the mixture in each example was maintained at about 6.0. Every laundering process described herein, unless otherwise stated within the cited AATCC test method, was performed in accordance with AATCC test method 130–1981, using wash procedure 1 (105° F. wash) and Tide® Detergent.

TABLE 1

| Substrate/Treatment | Spray Ratings As Received | 5 Washes | 10 Washes | 20 Washes | 30 Washes | 40 Washes | 50 Washes |
|---|---|---|---|---|---|---|---|
| Polyester: | | | | | | | |
| Untreated | 0 | 0 | 0 | 0 | 0 | 0 | 0 |
| 3.0% Repearl F-8025 | 100 | 100 | 100 | 100 | 100 | 100 | 100 |
| 3.0% Repearl F-8025/ 1.0% Millitex PD-75 | 90 | 70 | 80 | 80 | N/A | N/A | N/A |
| 3.0% Repearl F-8025/ 2.0% Millitex PD-75 | 80 | 70 | 70 | 70 | | N/A | N/A |
| 4.0% Repearl F-8025/ 2.0% Millitex PD-75 | 100 | 70 | 80 | 80 | 90 | 90 | 80 |
| Nylon: | | | | | | | |
| Untreated | 0 | 0 | 0 | 0 | 0 | 0 | 0 |
| 3.0% Repearl F-8025 | 100 | 100 | 100 | 90 | 80 | 70 | 0 |
| 1.0% Repearl F-8025/ 1.0% Millitex PD-75 | 90 | 70 | 50 | N/A | N/A | N/A | N/A |
| 1.0% Repearl F-8025/ 2.0% Millitex PD-75 | 100 | 70 | 70 | N/A | N/A | N/A | N/A |
| 2.0% Repearl F-8025/ 1.0% Millitex PD-75 | 100 | 90 | 80 | N/A | N/A | N/A | N/A |
| 2.0% Repearl F-8025/ 2.0% Millitex PD-75 | 90 | 80 | 70 | N/A | N/A | N/A | N/A |
| 3.0% Repearl F-8025/ 1.0% Millitex PD-75 | 70 | 80 | 80 | N/A | N/A | N/A | N/A |
| 3.0% Repearl F-8025/ 2.0% Millitex PD-75 | 100 | 70 | 50 | 50 | 0 | 0 | 0 |
| 4.0% Repearl F-8025/ 1.0% Millitex PD-75 | 100 | 90 | 70 | N/A | N/A | N/A | N/A |
| 4.0% Repearl F-8025/ 2.0% Millitex PD-75 | 100 | 100 | 80 | N/A | N/A | N/A | N/A |
| 4.0% Repearl F-8025/ 3.0% Millitex PD-75 | 100 | 80 | 50 | N/A | N/A | N/A | N/A |
| 5.0% Repearl F-8025/ 3.0% Millitex PD-75 | 100 | 90 | 50 | 50 | N/A | N/A | N/A |
| 5.0% Scotchgard FC-248 | 80 | 0 | 0 | 0 | | | |
| 5.0% Repearl F-84 | 80 | 50 | 0 | 0 | | | |
| 3.0% FC-251/ 2.0% Millitex PD-75 | 80 | 50 | 50 | N/A | N/A | N/A | N/A |
| 3.0% Zonyl 7040/ 2.0% Millitex PD-75 | 100 | 70 | 70 | N/A | N/A | N/A | N/A |
| 3.0% Repearl F-8025/ 2.0% Scotchgard FC-258 | 100 | 90 | 90 | N/A | N/A | N/A | N/A |
| 3.0% Repearl F-8025/ 2.0% Milease HPA | 100 | 100 | 100 | N/A | N/A | N/A | N/A |
| 3.0% Repearl F-8025/ 2.0% Lubril QCX | 100 | 100 | 90 | N/A | N/A | N/A | N/A |
| Cotton: | | | | | | | |
| Untreated | 0 | 0 | 0 | 0 | 0 | 0 | 0 |
| 3.0% Repearl F-8025 | 100 | 70 | 70 | 50 | 50 | 50 | 50 |
| 4.0% Repearl F-8025/ 2.0% Millitex PD-75 | 80 | 70 | 70 | 50 | 50 | 50 | 0 |
| 5.0% Repearl F-8025/ 3.0% Millitex PD-75 | 80 | 70 | 50 | 50 | N/A | N/A | N/A |
| 6.0% Repearl F-8025/ 3.0% Millitex PD-75 | 90 | 70 | 50 | 50 | N/A | N/A | N/A |
| Nomex: | | | | | | | |
| Untreated | 0 | 0 | 0 | N/A | N/A | N/A | N/A |
| 3.0% Repearl F-8025 | 100 | 90 | 90 | N/A | N/A | N/A | N/A |
| 3.0% Repearl F-8025/ 2.0% Millitex PD-75 | 90 | 50 | 50 | N/A | N/A | N/A | N/A |
| 5.0% Repearl F-8025 | 100 | 80 | 80 | N/A | N/A | N/A | N/A |
| 5.0% Repearl F-8025/ 2.0% Millitex PD-75 | 90 | 70 | 70 | N/A | N/A | N/A | N/A |
| 6.0% Repearl F-8025 | 100 | 100 | 90 | N/A | N/A | N/A | N/A |
| 6.0% Repearl F-8025/ 2.0% Millitex PD-75 | 70 | 70 | 90 | N/A | N/A | N/A | N/A |

In Table 1, the water repellency was tested before the first wash, after 5 washes, after 10 washes, after 20 washes, after 30 washes, after 40 washes, and after 50 washes. The rating scale is as follows:

100—No sticking or wetting of upper surface

90—Slight random sticking or wetting of upper surface

80—Wetting of upper surface at spray points

70—Partial wetting of whole of upper surface

50—Complete wetting of whole of upper surface

0—Complete wetting of whole upper and lower surfaces.

TABLE 2

| | Corn Oil Soil Release Ratings | | | | |
|---|---|---|---|---|---|
| Substrate/Treatment | 0/1 Wash | 4/5 Wash | 9/10 Wash | 19/20 Wash | 50/51 Wash |
| Polyester: | | | | | |
| Untreated | 5 | 1 | 1 | 1 | N/A |
| 3.0% Repearl F-8025 | 3.5 | 1 | 1 | 2 | 1 |
| 3.0% Repearl F-8025/ 1.0% Millitex PD-75 | 3 | 1 | 1 | 1 | |
| 3.0% Repearl F-8025/ 2.0% Millitex PD-75 | 5 | 5 | 4 | 3 | |
| 4.0% Repearl F-8025/ 2.0% Millitex PD-75 | 5 | 5 | 4 | 5 | 1 |
| Nylon: | | | | | |
| Untreated | 4 | 4 | 4 | 3 | |
| 3.0% Repearl F-8025 | 2 | 2 | 2 | 3.1 | 1 |
| 1.0% Repearl F-8025/ 1.0% Millitex PD-75 | 4 | 4 | 4 | N/A | |
| 1.0% Repearl F-8025/ 2.0% Millitex PD-75 | 4 | 4 | 4 | N/A | |
| 2.0% Repearl F-8025/ 1.0% Millitex PD-75 | 4.3 | 3.5 | 3.8 | 3.3 | |
| 2.0% Repearl F-8025/ 2.0% Millitex PD-75 | 5 | 4 | 4 | N/A | |
| 3.0% Repearl F-8025/ 1.0% Millitex PD-75 | 4 | 3 | 4 | N/A | |
| 3.0% Repearl F-8025/ 2.0% Millitex PD-75 | 4.3 | 3.5 | 3.5 | 3.5 | 3 |
| 4.0% Repearl F-8025/ 1.0% Millitex PD-75 | 3.5 | 3.5 | 3.5 | 3.5 | |
| 4.0% Repearl F-8025/ 2.0% Millitex PD-75 | 3.5 | 4 | 3.5 | 3.5 | |
| 4.0% Repearl F-8025/ 3.0% Millitex PD-75 | 4 | 4 | 5 | 4 | |
| 5.0% Repearl F-8025/ 3.0% Millitex PD-75 | 5 | 5 | 3.5 | 3.5 | |
| 5.0% Scotchgard FC-248 | 5 | 3 | 3 | 4 | |
| 5.0% Repearl F-84 | 5 | 5 | 3 | 2 | |
| 3.0% FC-251/ 2.0% Millitex PD-75 | 3.5 | 3.5 | 3.5 | N/A | |
| 3.0% Zonyl 7040/ 2.0% Millitex PD-75 | 4 | 3.5 | 3 | N/A | |
| 3.0% Repearl F-8025/ 2.0% FC-258 | 3 | 1 | 3.5 | N/A | |
| 3.0% Repearl F-8025/ 2.0% Milease HPA | 3 | 1 | 1 | N/A | |
| 3.0% Repearl F-8025/ 2.0% Lubril QOX | 2.5 | 1 | 2 | N/A | |
| Cotton: | | | | | |
| Untreated | 3 | 3 | 3 | 3 | |
| 3.0% Repearl F-8025 | 1 | 1 | 1 | 1 | 1 |
| 4.0% Repearl F-8025/ 2.0% Millitex PD-75 | 3.3 | 3 | 3 | 3 | 2 |
| 5.0% Repearl F-8025/ 3.0% Millitex PD-75 | 5 | 3 | 3 | N/A | |
| 6.0% Repearl F-8025/ 3.0% Millitex PD-75 | 4 | 3 | N/A | N/A | |
| Nomex: | | | | | |
| Untreated | N/A | N/A | N/A | N/A | |
| 3.0% Repearl F-8025 | 2 | 3.5 | 3 | N/A | |
| 3.0% Repearl F-8025/ 2.0% Millitex P0-754 | 4 | 4 | 3.5 | N/A | |
| 5.0% Repearl F-8025 | 2 | 3 | 4 | N/A | |
| 5.0% Repearl F-8025/ 2.0% Millitex PD-75 | 3.5 | 4 | 3.5 | N/A | |

TABLE 2-continued

| | Corn Oil Soil Release Ratings | | | | |
|---|---|---|---|---|---|
| Substrate/Treatment | 0/1 Wash | 4/5 Wash | 9/10 Wash | 19/20 Wash | 50/51 Wash |
| 6.0% Repearl F-8025 | 1.5 | 2 | 1 | N/A | |
| 6.0% Repearl F-8025/ 2.0% Millitex P0-75 | 5 | 4 | 3.5 | N/A | |

The Soil Release test was conducted in accordance with AATCC test method 130–1981. The staining agents used in the Soil Release tests were corn oil (CO) and mineral oil (MI). The rating scale is 1–5, with a 1 indicating the poorest degree of stain removal, and a 5 indicating the best degree of stain removal. Generally, a rating of 3.5 is about the maximum acceptable stain level for normal wear and use.

FIG. 1 is a graphical representation of a soil release test in accordance with Table 2, where three separate nylon substrates were tested, again according to the AATCC Test Method 130–1981. The untreated nylon shows acceptable soil release ratings through 20 launderings. Nylon treated with the fluorocarbon treatment consistently shows poor soil release ratings. Nylon treated with the novel mixture containing fluorocarbon polymers, specifically REPEARL F-8025 and hydrophilic soil release polymers, specifically PD-75, shows consistently high levels of soil releasability.

FIG. 2 is a graphical representation of a soil release test in accordance with Table 2, where three separate nylon substrates were tested according to the same AATCC Test Method 130–1981. The nylon treated with FC-248 mirrors the soil releasability performance of the nylon treated with the fluorochemical/soil release mixture of the present invention. The nylon treated with the F-84 shows superior soil release ratings through 5 washes, but drops to a level of 3 after 10 and 20 washes. Both FC-248 and F-84 are copolymers containing fluorocarbon oil/water repellent segments and hydrophilic soil release segments.

FIG. 3 is a graphical representation of water repellency spray ratings in accordance with Table 1, where three separate nylon substrates were tested according to the AATCC Test Method 22–1980. The untreated nylon showed a consistent rating of 0, meaning that it had no water repellency characteristics whatsoever. The nylon treated with only the fluorocarbon polymer showed consistent ratings of 100 through 20 launderings, dropping to 70 after 40 washes, while the nylon treated with the fluorocarbon/soil release mixture initially showed a rating of 100, then dropped to 50 after 10 washes and remained at 50 through 20 washes.

FIG. 4 is a graphical representation of a similar test as shown in FIG. 3, where the three nylon tests include a fabric treated with FC-248, a second nylon fabric treated with F-84, and a third nylon treated in accordance with the invention, with the fluorocarbon/soil release mixture. The FC-248 treated nylon shows a spray rating of 80 initially, but then drops to 0 after 5 washes and subsequent washes. The F-84 treated nylon initially shows a spray rating of 80, dropping to 50 after 5 washes, and subsequently dropping to 0 after 10 launderings. The fluorocarbon/soil release treated nylon shows an initial spray rating of 100, dropping to a rating of 70 after 5 and 10 washes, and then dropping to 50 after 20 launderings. It may be seen from this Figure that the nylon treated in accordance with this invention is the only one having durable water repellency characteristics, through at least 10 launderings.

FIGS. 5 and 6 are graphical representations of corn oil soil release tests performed on polyester (S/784830) and cotton respectively, as shown in Table 2. The tests were conducted in accordance with the AATCC Test Method 130–1981, and the products tested included untreated substrate, substrate treated with a durable water repellent, and substrate treated with a fluorocarbon polymer and a hydrophilic soil release polymer in accordance with the instant invention. As shown in FIG. 5, the polyester (S/784830) treated with the fluorocarbon polymer and the soil release agent, the soil release levels were consistently maintained at a 5.0, the highest level, through 20 washings. The results were significantly lower for the untreated polyester and the polyester treated with a durable water repellent alone.

FIG. 6 shows the soil release results for cotton, where the untreated cotton exhibits a constant level of 3.0 throughout the 20 washings. The cotton treated with the fluorocarbon polymer and the soil release agent fared similarly, initially showing a rating of 3.5, and then dropping to a level of 3.0 after 20 washings. The cotton treated with only the durable water repellent agent showed consistently poor results, maintaining a constant soil release level of 1 through 20 washings.

FIGS. 7 and 8 are graphical representations of the spray ratings tests performed on polyester (S/784830) and cotton respectively, as shown in Table 1. The tests were conducted in accordance with AATCC Test Method 22–1980, and the products tested included untreated substrate, substrate treated with a durable water repellent, and substrate treated with a fluorocarbon polymer and a hydrophilic soil release polymer in accordance with the instant invention.

As shown in FIG. 7, regarding the polyester (S/784830), the untreated polyester exhibited absolutely no water repellency characteristics, showing a rating of 0. The polyester treated only with the durable water repellency agent performed the best, consistently maintaining a rating of 100, the highest rating, through 50 washes. The polyester treated with the fluorocarbon polymer and soil release agent varied between 100 and 70, but indicated an 80 rating after 50 washes (4%REPEARL F-8025 2% PD-75).

FIG. 8 shows the spray ratings for cotton. The untreated cotton consistently shows absolutely no water repellency, scoring a level of 0 through 50 washings. The cotton treated with only a fluorocarbon polymer showed strikingly similar results with the cotton treated with both the fluorocarbon polymer and the soil release agent. Initially, the sole fluorocarbon treatment shows a rating of 100, while the cotton with the combination coating scores a rating of 80. In subsequent washes, both treated cotton substrates perform identically through 40 washes, and then the combination coated cotton drops to 0, while the fluorocarbon treatment alone stands at a rating of 50 after 50 washes.

Another test was performed to determine the air permeability of a polyester/cotton blend treated in accordance with this process, and compared to similar fabrics either untreated or treated with the Repearl F-8025 fluorocarbon coating. The results are shown in Table 3, below. The test was performed in accordance with ASTM test method D737-96, with air pressure at 100 Pa (Pascals), and the measurements in "cfm" units, meaning cubic feet per minute.

TABLE 3

Effect of Finish on Fabric Breathability

| Treatment: | Air Permeability: |
|---|---|
| Untreated | 42 cfm |
| DWR | 40 cfm |
| DWR with Soil Release | 41 cfm |

It can be seen from the above table that air permeability was not significantly affected by either the fluorocarbon treatment or the combination treatment in accordance with the present invention.

Although it has been known to use fluorocarbon polymers and hydrophilic soil release polymers alone or separately in order to obtain the durable water and oil repellency and durable soil release capabilities, it has proven difficult to simultaneously obtain those characteristics, particularly within a single bath. Because the polymers have a tendency to work against each other, it has been surprising to find fluorocarbon polymers and hydrophilic soil release polymers that work well together, as shown in Tables 1–2, and FIGS. 1–8. The concentrations of the respective polymers within the mixture, in combination with the ratios of the polymers and the choices of specific polymers seem to play a significant role in determining the success of the process and product, particularly with respect to durability. This process may be carried out in a preferred embodiment in a generally neutral or slightly acidic pH, most preferably between about 6 and 7, which allows the process to be performed on a wide variety of textile substrates that may not be capable of withstanding more extreme pH values. Indeed, polyamides, aramids, polyesters, and poly/cotton substrates, when treated according to the present process, have all yielded improved performance with respect to durable water and oil repellency and durable soil release characteristics.

Although the present invention has been described in considerable detail with reference to certain preferred versions thereof, other versions are possible. For example, products treated with the bath described herein may have any number of uses, including but not limited to such uses as outerwear apparel (stretch and non-stretch), shower curtains, bedspreads, curtains, drapes, sleeping bags, upholstery fabrics, automotive fabrics, outdoor furniture, awnings, protective coverings for boats, grills and the like, sportswear for hunting, fishing and skiing, etc. The treatment may be used advantageously on fabrics of any construction, including but not limited to wovens, knits, and non-wovens.

Therefore, the spirit and scope of the appended claims should not be limited to the description of the preferred versions contained herein. All features disclosed in this specification may be replaced by alternative features serving the same, equivalent or similar purpose, unless expressly stated otherwise. Thus, unless expressly stated otherwise, each feature disclosed is one example only of a generic series of equivalent or similar features.

What is claimed is:

1. A method for treating substrates to obtain durable water repellency and improved durable soil release attributes, said method comprising the steps of:

providing a mixture having a fluorocarbon polymer and a hydrophilic soil release polymer, wherein the ratio of fluorocarbon polymer solids and hydrophilic soil release Polymer solids is in the range of 1:1 and 5:1, and where the pH of said mixture is between about 4 and 7;

applying said mixture to a textile substrate; and drying said coated substrate, wherein said hydrophilic soil release polymer is a cationic polymer.

2. The method set forth in claim 1, wherein said cationic hydrophilic polymer is a polyacrylamide polymer.

3. A method for treating substrates to obtain durable water repellency and improved durable soil release attributes, said method comprising the steps of:

providing a mixture having a fluorocarbon polymer and a hydrophilic soil release polymer, wherein the ratio of fluorocarbon polymer solids and hydrophilic soil release polymer solids is in the range of 1:1 and 5:1, and where the pH of said mixture is between about 4 and 7;

applying said mixture to a textile substrate; and drying said coated substrate, wherein said hydrophilic soil release polymer is a nonionic polymer and wherein said nonionic hydrophilic polymer is an ethoxylated polymer.

* * * * *